US005211617A

United States Patent [19]

Millen

[11] Patent Number: 5,211,617

[45] Date of Patent: May 18, 1993

[54] TORSION EXERCISING DEVICE

[76] Inventor: Roy F. Millen, 109 Belhaven, Shreveport, La. 71118

[21] Appl. No.: 785,521

[22] Filed: Oct. 31, 1991

[51] Int. Cl.[5] ..... A63B 21/045

[52] U.S. Cl. ..... 482/127; 482/130; 482/137; 482/908

[58] Field of Search ..... 482/44, 45, 46, 92, 482/112, 113, 121, 122, 123, 126, 127, 129, 130, 133, 137, 142

[56] References Cited

U.S. PATENT DOCUMENTS

| | | | |
|---|---|---|---|
| 3,495,824 | 2/1970 | Cuinier | 482/137 X |
| 3,510,130 | 5/1970 | Ferdinand | 482/127 X |
| 3,567,219 | 3/1971 | Foster | 482/130 |
| 4,226,415 | 10/1980 | Wright | 482/137 X |
| 4,397,462 | 8/1983 | Wilmarth | 482/137 X |
| 4,521,013 | 6/1985 | Dofel | 482/130 |
| 4,600,189 | 7/1986 | Olschansky et al. | 482/137 X |
| 4,647,041 | 3/1987 | Whiteley | 482/137 X |
| 4,667,955 | 5/1987 | Giesch | 482/137 X |
| 4,693,467 | 9/1987 | Ikäheimo | 482/130 X |
| 4,709,923 | 12/1987 | Gibson | 482/130 X |
| 4,720,100 | 1/1988 | Du Buy | 482/112 X |
| 4,725,057 | 2/1988 | Shifferaw | 482/130 |
| 4,872,669 | 10/1989 | Henry | 482/137 X |
| 4,979,736 | 12/1990 | Maynard | 482/137 |
| 5,037,090 | 8/1991 | Fitzpatrick | 482/137 X |
| 5,039,092 | 8/1991 | Olschansky et al. | 482/137 X |

FOREIGN PATENT DOCUMENTS

| | | | |
|---|---|---|---|
| 1153143 | 5/1969 | United Kingdom | 482/112 |
| 8807879 | 10/1988 | World Int. Prop. O. | 482/113 |

*Primary Examiner*—Robert Bahr

*Attorney, Agent, or Firm*—John M. Harrison

[57] ABSTRACT

A torsion exercising device which includes a support frame for supporting the exerciser and one end of a pivot arm assembly in pivotally adjustable relationship with a power frame mounted on the opposite end of the pivot arm assembly. The power frame includes a mount bar for rigidly securing the power frame to the pivot arm assembly, a torque tube rotatably and adjustably mounted in the power frame parallel to the mount bar and a torsion bar disposed in sliding relationship inside the torque tube, wherein the exerciser may adjust the rotational position and linear extension of the torsion bar inside the torque tube to create a desired position and resistance for pulling and pushing exercises.

13 Claims, 2 Drawing Sheets

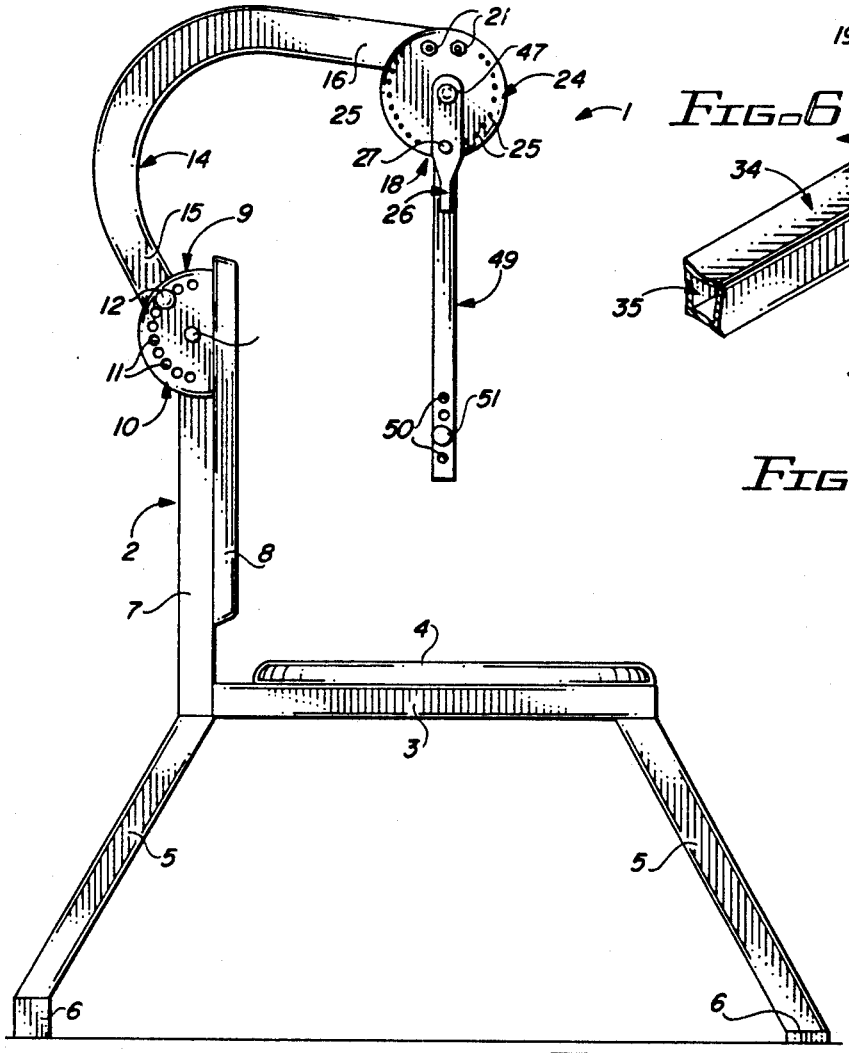
FIG. 1
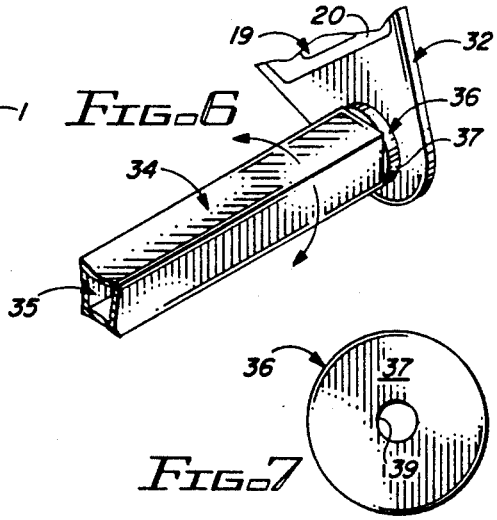
FIG. 6
FIG. 7
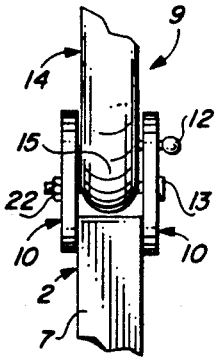
FIG. 3
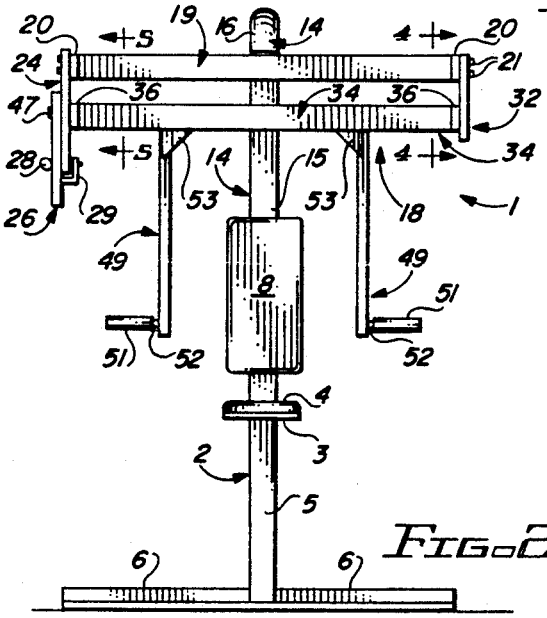
FIG. 2
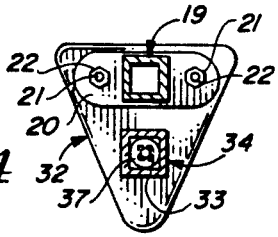
FIG. 4
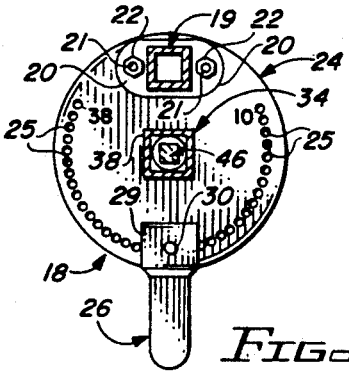
FIG. 5

TORSION EXERCISING DEVICE

BACKGROUND OF THE INVENTION

1. Field of the Invention

This invention relates to resistance exercising devices and more particularly, to a torsion exercising device which utilizes a torsion bar of selected size and composition mounted in a torque tube to provide resistance in pushing and pulling exercises. In a most preferred embodiment of the invention the torsion exercising device includes a chair base support frame for receiving an exerciser in seated position, a pivot arm assembly which includes a curved pivot arm having one end attached to the support frame in pivotally adjustable fashion and the opposite end provided with an adjustable power frame which includes a fixed mount bar, as well as a torsion bar sliding inside a torque tube. A desired degree of rotational tension or torque is effected in the torsion bar by adjusting the torque tube and operating a pair of downwardly-extending arms attached to the torque tube in a desired configuration responsive to a selected configuration of the pivot arm. Various pulling and pushing exercising configurations can be effected by adjustment of the pivot arm assembly and the arms and torsion bar in the power frame to effect a well rounded, complete exercise program.

One of the problems associated with many exercising devices, including various air-operated and chain or cable-driven devices is that of limited muscle group exercise capability in any one machine. Various machines have been developed with a view towards exercising specific muscles or muscle groups, but in most cases each machine is designed to exercise a particular muscle or muscle group and is not capable of exercising other muscles or muscle groups. Other machines have been developed for exercising multiple muscle groups, but in many cases these machines have proved to be complex and require various time-consuming adjustments in order to convert from the exercise of one group or groups to another.

2. Description of the Prior Art

Various types of exercising devices involving springs, and torsion springs in particular, of various design are known in the art. Among these are the following: U.S. Pat. No. 4,155,547, dated May 22, 1979, to Dino M. Savio, et al, entitled "Torsion Spring Type Wrist Exercising Device"; U.S. Pat. No. 4,235,437, dated Nov. 25, 1980, to David A. Ruis entitled "Robotic Exercise Machine and Method"; U.S. Pat. No. 4,343,465, dated Aug. 10, 1982, to Dan V. Allen, entitled "Spring Type Arm Wrestling Device"; U.S. Pat. No. 4,478,413, dated Oct. 23, 1984, to John T. Siwula, entitled "Torsion Type Exercise Device"; U.S. Pat. No. 4,576,377, dated Mar. 18, 1986, to Leslie C. Wolff, entitled "Athletic Exerciser Assembly"; U.S. Pat. No. 4,643,420, dated Feb. 17, 1987, to Robert Q. Riley, et al, entitled "Floor-Mounted Exercise Machine"; U.S. Pat. No. 4,645,205, dated Feb. 24, 1987, to Lesley C. Wolff, entitled "Athletic Exerciser for Paraplegics and Quadriplegics"; U.S. Pat. No. 4,750,740, dated Jun. 14, 1988, to Brian E. Lara, entitled "Torsion Spring Exercise Machine"; U.S. Pat. No. 4,844,448, dated Jul. 4, 1989, to Michael D. Niznik, entitled "Stand-Up Exerciser"; and U.S. Pat. No. 4,979,734, dated Dec. 25, 1990, to Anthony M. Sims, entitled "Multi-Purpose Hydraulic Exercise Apparatus".

It is an object of this invention to provide a torsion exercising device which includes a support frame for supporting an exerciser, a pivot arm assembly adjustably mounted on the support frame, a power frame having a mount bar fixed to the pivot arm assembly and a torsion bar seated in a torque tube adjustably attached to the pivot arm assembly for creating push and pull exercises of selectively varying force responsive to twisting of the torsion bar.

Another object of the invention is to provide a new and improved torsion exercising device which utilizes a torsion bar spring system and a connecting adjustable pivot arm to provide multiple variable pushing and pulling resistive forces and exercise positions which fit the exercising needs of substantially any exerciser.

Still another object of this invention is to provide a torsion exercising machine which includes a power frame mounted on one end of a pivot arm assembly, the other end of which assembly is attached in adjustable relationship to a support frame, which power frame includes a torsion bar system, the resistive forces of which depend upon the size, length and degree of rotation thereof.

A still further object of the invention is to provide a new and improved torsion exercising device which utilizes a torsion bar of selected size and character slidably mounted in a torque tube, wherein the effective length and degree of rotation of the torsion bar may be varied to create resistive forces of selected magnitude in both pushing and pulling exercising configurations.

Yet another object of this invention is to provide a torsion exercising device which includes a power frame having a mount bar secured in fixed relationship on one end of a pivot arm assembly which is, in turn, adjustably mounted on a chair base support frame, wherein the power frame includes a torque tube fitted with a sliding, adjustable torsion bar of selected size and capable of being twisted or torqued with equal force in either direction of rotation to create the capacity for both pushing and pulling exercises.

Another object of the invention is to provide a torsion exercising machine or device which includes a power frame mounted on one end of a curved pivot arm, which pivot arm is, in turn, adjustably mounted on a chair base support frame, the power frame further including a torsion bar slidably mounted inside a torque tube in such a manner that the torsion bar may be preloaded by an exerciser in either a push or pull resistive mode to create additional push or pull resistive force, as desired.

Still another object of this invention is to provide a torsion exercising device which is characterized by a power frame pivot arm assembly supporting a power frame and a chair-type support frame adjustably attached to the pivot arm assembly to facilitate such vertical exercises as sitting military presses and vertical pull downs, and horizontal exercises such as curls, rowing, sitting bench presses and like exercises, in non-exclusive particular, responsive to grasping of spaced arms and twisting of a torsion bar slidably seated in a torque tube attached to the arms.

SUMMARY OF THE INVENTION

These and other objects of the invention are provided in a torsion exercising device which is characterized by a rigid chair base support frame provided with an adjustable pivot arm assembly having a curved pivot arm, a power frame mounted on one end of the pivot arm by means of a mount bar, which power frame is also fitted with a torque tube supporting a pair of downwardly-extending arms for gripping by the exerciser. The arms and torque tube may be adjusted by means of a rotating adjustment handle, along with the pivot arm assembly, to position the arms in any selected configuration with respect to the exerciser and facilitate pushing or pulling the arms against the bias in a torsion bar slidably mounted in the torque tube, to create forces of various magnitude against the arms and legs of the user.

BRIEF DESCRIPTION OF THE DRAWINGS

The invention will be better understood by reference to the accompanying drawings, wherein:

FIG. 1 is a right side elevation of a preferred embodiment of the torsion exercising device of this invention;

FIG. 2 is a front elevation of the torsion exercising device illustrated in FIG. 1;

FIG. 3 is a sectional view of a preferred pivot arm assembly element of the torsion exercising device illustrated in FIGS. 1 and 2;

FIG. 4 is a sectional view taken along line 4—4 of the torsion exercising device illustrated in FIG. 2;

FIG. 5 is a sectional view taken along line 5—5 of the torsion exercising device illustrated in FIG. 2;

FIG. 6 is a perspective view, partially in section, of the non-adjusting end of the torque tube element of the torsion exercising device, more particularly illustrating a preferred rotational mounting of the torque tube to a corresponding fixed plate element of the power frame;

FIG. 7 is an end view of one of the bearings provided in the non-adjusting end of the torque tube;

DESCRIPTION OF THE PREFERRED EMBODIMENTS

Figure 8:
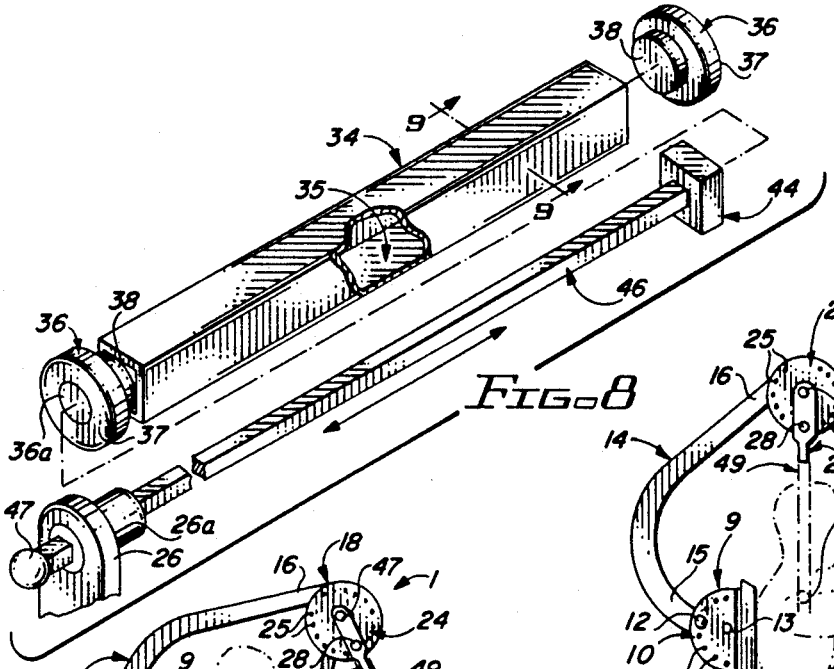
FIG. 8 is a perspective view, partially in section, of a preferred embodiment of the torque tube and torsion bar elements of the power frame of the invention.
Figure 9:
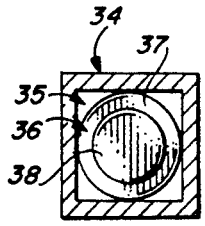
FIG. 9 is a sectional view taken along 9—9 of the torque tube illustrated in FIG. 8.

Referring initially to FIGS. 1-3 of the drawings, the torsion exercising device of this invention is generally illustrated by reference numeral 1. The torsion exercising device 1 is characterized by a rigid support frame 2, having a horizontal seat member 3, supported by legs 5 and a pair of parallel leg bases 6. A seat pad 4 is provided on the seat member 3 to accommodate an exerciser and a back support 7 projects upwardly from one end of the seat member 3 and is fitted with a back pad 8, as further illustrated in FIGS. 1 and 2. A pivot arm assembly 9 is mounted on the upper end of the back support 7 and includes a pair of spaced pivot arm plates 10, which are welded or otherwise fixedly attached to the back support 7 and a curved pivot arm 14, the proximal end 15 of which is pivotally secured between the parallel pivot arm plates 10 by means of a pivot arm bolt 13 and nut 22, as illustrated in FIGS. 1 and 3. The pivot arm plates 10 are further provided with pivot arm plate openings 11, which are aligned to receive a pivot arm pin 12, extending through a corresponding opening (not illustrated) in the proximal end 15 of the pivot arm 14, as further illustrated in FIGS. 1 and 3. The pivot arm 14 curves upwardly and forwardly to receive a power frame 18 at the distal end 16. As further illustrated in FIGS. 1 and 2, the power frame 18 is further characterized by a horizontal mount bar 19, attached to the distal end 16 of the pivot arm 14 near the center of the mount bar 19 by welding or other fixed means. The mount bar 19 is further fitted with a pair of mount bar brackets 20 at each end and a circular adjustment plate 24 is bolted to one of the mount bar brackets 20, while a fixed plate 32 is bolted to the opposite mount bar bracket 20 located on the opposite end of the mount bar 19, by means of bracket bolts 21 and corresponding nuts 22, respectively.

Referring now to FIGS. 1, 2 and 4-9 of the drawings, a torque tube 34 extends parallel to and below the mount bar 19 and is pivotally attached to the adjustment plate 24 on one end and the fixed plate 32 at the opposite end, as illustrated in FIG. 2. The torque tube 34 is attached to the fixed plate 32 by means of a bearing 36, as illustrated in FIGS. 6 and 7, which bearing 36 is characterized by a bearing cap 37, having a central plug receptacle 39 and a bearing flange 38 which projects into the torsion bar chamber 35 of the torque tube 34. The fixed plate 32 is also provided with a plate plug 33, which projects into the plug receptacle 39 provided in the bearing cap 37, as illustrated in FIGS. 4 and 7. Accordingly, when the torque tube 34 is sandwiched between the adjustment plate 24 on one end and the fixed plate 32 on the other end, projection of the plate plug 33 into the corresponding plug receptacle 39 of the bearing cap 37 facilitates rotation or pivoting of the torque tube 34 in the direction of the arrows illustrated in FIG. 6. The opposite end of the torque tube 34 is attached to the adjustment plate 24 by means of a second bearing 36, which includes a pivot opening 36*b*, that receives the adjustment handle pivot 26*a*, projecting from the adjustment handle 26. Like the bearing 36 positioned between the fixed plate 32 and the corresponding end of the torque tube 34, the bearing 36 located on the opposite end of the torque tube 34 at the adjustment plate 24 is also fitted with a bearing flange 38, which projects into the torsion bar chamber 35 when the bearing 36 is assembled on the torque tube 34, as further illustrated in FIG. 8.

Referring now to FIGS. 1, 2, and 8 of the drawings, the circular adjustment plate 24 is further provided with multiple, spaced adjustment openings 25 and the square receptacle of the adjustment handle pivot 26*a* of the adjustment handle 26 receives the exposed end of the square torsion bar 46, which is slidably disposed in the torque tube 34, as hereinafter further described. The adjustment handle 26 projects from attachment to the torsion bar 46, across the circular alignment of the adjustment plate openings 25 and extends past the periphery of the adjustment plate 24, as illustrated. An adjustment handle opening 27 is located in the adjustment handle 26 in selective alignment with the respective adjustment plate openings 25, such that manipulation of the adjustment handle 26 in an arc over the curved and spaced adjustment plate openings 25 facilitates selective alignment of the adjustment plate opening 27 with a selected one of the adjustment plate openings 25. The adjustment handle 26 is further provided with an adjustment handle bracket 29, which projects from the adjustment handle 26 around the periphery of the adjustment plate 24 and a bracket opening 30 is located in the adjustment plate bracket 29 in alignment with the adjustment handle opening 27 in the adjustment handle 26, as illustrated in FIG. 2. An adjustment handle pin 28 is inserted through the adjustment handle opening 27 and a selected one of the adjustment plate openings 25 and then through the corresponding aligned bracket opening 30, to secure the adjustment handle 26 in a desired orientation with respect to the adjustment plate 24, as further hereinafter described.

Referring again to FIG. 8 of the drawings, in a most preferred embodiment of the invention the torsion bar 46 is slidably disposed inside the torsion bar chamber 35 of the torque tube 34. The torsion bar 46 projects through the internal square opening of the adjustment handle pivot **26*a* in the adjustment handle 26, receives a square torsion bar spacer 44 on one end and a torsion bar knob 47 is fixed to the exposed end of the torsion bar 46. The exposed end of the torsion bar 46 which receives the torsion bar knob 47 projects through the adjustment handle pivot 26*a* and seats therein, as heretofore described. Accordingly, manipulation of the adjustment handle 26 around the curvature of the adjustment plate 24 and over the adjustment plate openings 25 also rotates the torque tube 34 on the respective bearings 36, as further hereinafter described. A pair of parallel arms 49 are welded or otherwise attached to the torque tube 34 and are braced by arm gussets 53, as illustrated in FIG. 2. Each of the arms 49 is provided with grip pin openings 50 which are spaced in the extending ends of the arms 49, as further illustrated in FIG. 1. Grips 51 receive grip pins 52, which are inserted in selected ones of the grip pin openings 50 located in the arms 49, for gripping and operating the torsion exercising device 1**, as hereinafter further described.

Figure 10:
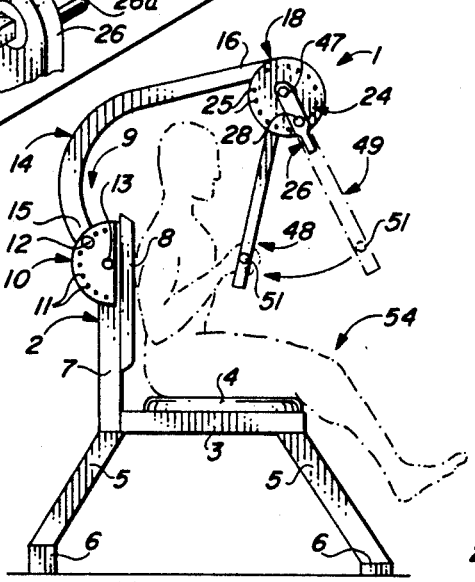
FIG. 10 is a right side elevation of a first preferred exercising configuration of the torsion exercising device of this invention.

In operation, and referring to FIGS. 1–10 of the drawings, an exerciser 54 is seated on the seat pad 4 of the seat member 3, with his back resting against the back pad 8 in the support frame 2 of the torsion exercising device 1. The pivot arm 14 has been adjusted in the pivot arm plates 10 by initially removing the pivot arm pin 12, rotating the pivot arm 14 on the pivot arm bolt 13 to adjust the distal end 16 and power frame 18 to the illustrated overhead position and reinserting the pivot arm 12 through aligned pivot arm plate openings 12 and through an opening (not illustrated) in the proximal end 15 of the pivot arm 14. The exerciser 54 then grips the respective grips 51 projecting from the arms 49 and exercises by pulling the arms 49 from the position illustrated in phantom to the retracted position, against tension in the torsion bar 46. This desired tension is created by initially removing the adjustment handle pin 28 from the adjustment handle opening 27, corresponding adjustment plate handle opening 25 and bracket opening 30, as illustrated in FIGS. 1 and 5, and moving the adjustment handle 26 and arms 49 in the counterclockwise direction to rotate the torque tube 34 and enclosed torsion bar 46 to a desired forward position, as illustrated in FIG. 10. When this desired position is reached, the adjustment handle pin 28 is re-inserted in the aligned adjustment handle opening 27, corresponding selected adjustment plate opening 25 and bracket opening 30 in the adjustment plate bracket 29, to secure the torque tube 34 in position. Grasping the grips 51 and pulling the arms 49 in the direction of the arrow thus applies a torque to the torsion bar 46, which is locked inside the torque tube 34 by operation of the torsion bar spacer 44 at one end and the adjustment handle 26 on the other, as the exerciser 54 pulls repetitively against the resistive force.

Figure 11:
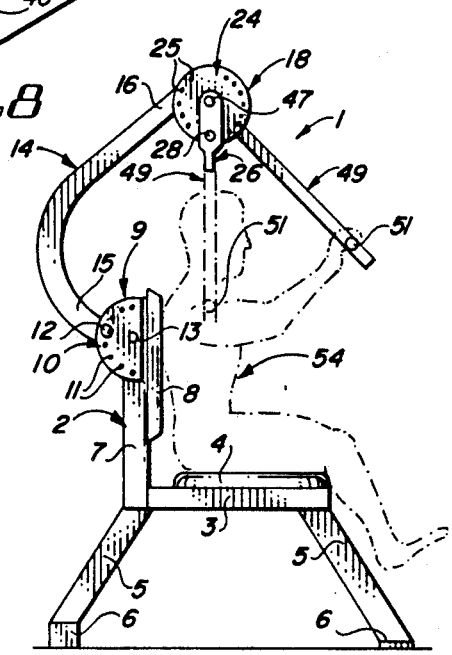
FIG. 11 is a right side elevation of a second preferred exercising configuration.

Referring now to FIG. 11 of the drawings, under circumstances where a pushing exercise is desired, the exerciser 54 adjusts the pivot arm 14 and power frame 18 as indicated above, to the illustrated position. He then removes the adjustment handle pin 28, also as described above, and rotates the adjustment handle 26 and arms 49, along with the torque tube 34 and enclosed torsion bar 46, to the vertical orientation illustrated in phantom. The adjustment handle pin 28 is then reinserted in the adjustment handle opening 27, selected adjustment plate opening 25 and corresponding bracket opening 30 in the adjustment plate bracket 29, the grips 51 are grasped by the exerciser 54 and the arms 49 pushed forwardly in the direction of the arrow against the torque in the torsion bar 46, to effect the desired repetitive pushing exercise.

Figure 12:
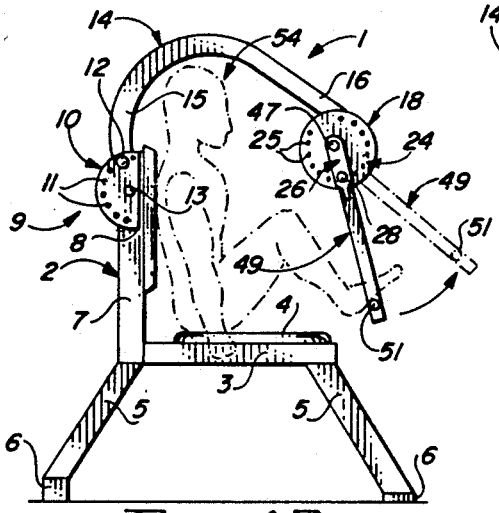
FIG. 12 is a right side elevation of a third preferred exercising configuration.

Referring now to FIG. 12 of the drawings, under circumstances where it is desired to exercise the legs in a pushing exercising operation, the pivot arm 14 and power frame 18 are again readjusted and the exerciser 54 removes the pivot arm pin 12 from aligned pivot arm plate openings 11 in the parallel pivot arm plates 10 and the corresponding aligned opening in the proximate end 15 of the pivot arm 14, as indicated above. The pivot arm 14 is then pivoted forward to the position illustrated, where the pivot arm pin 12 is reinserted to maintain this position. The adjustment handle pin 28 is then removed as described above, to facilitate rotation of the arms 49 forwardly to the position illustrated in phantom, where the adjustment handle pin 28 is reinserted to maintain the torque tube 34 and enclosed torsion bar 46 in this position. The pressure exerted on the grips 51 by the feet of the exerciser 54 then repetitively forces the arms 49 forwardly in the direction of the arrow to the position illustrated in phantom against the tension in the torsion bar 46.

Figure 13:
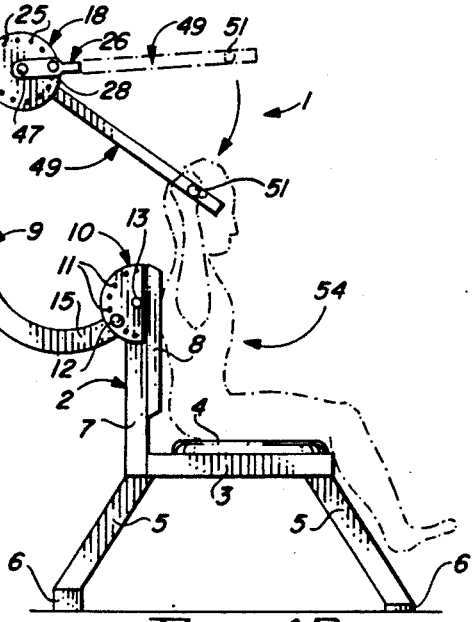
FIG. 13 is a right side elevation of a fourth preferred exercising configuration of the torsion exercising device of this invention.

Referring to FIG. 13 of the drawings, if it is desired to exercise the shoulder and back muscles in a downwardly pulling direction, the pivot arm 14 is manipulated upwardly and rearwardly by initial removal of the pivot arm pin 12, rotation of the pivot arm 14 to the desired position and reinsertion of the pivot arm pin 12 through selected aligned ones of the pivot arm plate openings 11, as described above. The adjustment handle 26, torque tube 34 and arms 49 are then rotated in a counterclockwise direction, such that the adjustment handle 26 and arms 49 are located in approximately horizontal configuration by initially removing, and then reinserting the adjustment handle pin 28, as described above. Repetitive exercising is then accomplished against the tension in the torsion bar 46 by pulling downwardly in the direction of the arrow, as illustrated.

Referring again to FIG. 8 of the drawings, it will be appreciated by those skilled in the art that the tension in the torsion bar 46 may be varied by grasping the torsion bar knob 47 and manually slidably extending the torsion bar 46 from the torsion bar chamber 35. It will be further appreciated that slidably extending the torsion bar 46 thusly, facilitates movement of the torsion bar spacer 44 inside the torsion bar chamber 35 toward the adjustment handle 26 and subjects less of the length of the torsion bar 46 to torquing forces exemplified by the exercising configurations illustrated in FIGS. 10–13. Consequently, the torsion bar spacer 44 serves to transmit torque from the torsion bar 46 to the torque tube 34 as the torsion bar 46 is torqued about a reduced length when it is extended from the torque tube 34 and the force required to move the arms 49 increases and is therefore proportional to the length of the torsion bar 46 which remains inside the torsion bar chamber 35 of the torque tube 34. Accordingly, the exerciser 54 may adjust the desired tension in the torsion bar 46 by slidably manipulating the torsion bar 46 and torsion bar spacer 44 in the torsion bar chamber 35, as desired.

It will be further appreciated by those skilled in the art that the torsion exercising device 1 may be fitted with a torsion bar 46 of desired size and tension according to metallurgical techniques which are well known in the art. Thus, a desired tension or torquing force in both the push and pull directions can be achieved by selecting a torsion bar 46 having appropriate characteristics. Since the torque tube 34 is interchangeable in the power frame 18, various torque tubes 34 having torsion bars 46 of selected size and torqueing characteristics may be interchanged as desired, to facilitate adjustment of the required exercising forces in the torsion exercising device 1. Furthermore, conventional "rubber spring" torsion springs may be used in the torsion exercising device with minor modification, as desired.

Referring again to FIG. 10 of the drawing, it will be appreciated that the torsion bar 46 may be "preloaded" to effect an additional pushing force by initially locating the arms 49 in an exaggerated clockwise rotation with respect to the adjustment plate 24, farther than the position illustrated in phantom in FIG. 11. Accordingly, when the exerciser 54 grasps the grips 51 and forces the arms 49 to the vertical position illustrated in FIG. 11, the pre-torqueing force has been applied and additional extension of the arms 49 in the direction of the arrow to the position illustrated requires additional force in the exercising function. Similarly, a "pre-loading" pulling torque can be applied by duplicating this effort in the configuration illustrated in FIG. 10.

It will be appreciated and understood that the exercising functions illustrated in FIGS. 10–13 are only exemplary and further while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A torsion exercising device comprising support means for supporting an exerciser in exercising configuration; a pivot arm assembly characterized by at least one pivot arm plate carried by said support means in fixed relationship, a plurality of pivot arm plate openings provided in spaced relationship in said pivot arm plate, a pivot arm having one end pivotally carried by said pivot arm plate and a pivot arm pin adapted for projecting through a selected one of said pivot arm plate openings and engaging said pivot arm for orienting said pivot arm in a selected exercising position with respect to the exerciser; power frame means carried by the opposite end of said pivot arm in said pivot arm assembly in fixed relationship; torsion bar means carried by said power frame means in pivotal relationship and arm means provided on said torsion bar means, whereby said torsion bar means is subjected to a torsional force responsive to manipulation of said arm means by the exerciser.

2. The torsion exercising device of claim 1 wherein said support means further comprises a support frame having a seat and a back support for receiving the exerciser in a seated position.

3. The torsion exercising device of claim 1 wherein said power frame means further comprises at least one mount bar fixedly carried by said pivot arm and bracket means provided on each end of said opposite end of said mount bar and said torsion bar means further comprises a torque tube pivotally carried by said bracket means; a torsion bar slidably disposed in said torque tube for adjusting the torque in said torsion bar; and adjustable lock means carried by one end of said torsion bar for locking said torsion bar in a selected orientation with respect to said mount bar, and wherein said arm means are attached to said torque tube, whereby said torsional force is created in said torsion bar responsive to movement of said arm means by the exerciser.

4. The torsion exercising device of claim 3 wherein said adjustable lock means further comprises an adjustment handle having one end attached to said torsion bar; a pin opening provided in said adjustment handle; an adjustment plate fixedly carried by said mount bar; adjustment plate openings provided in said adjustment plate in spaced relationship; and an adjustment plate pin for selective registration with said pin opening and said adjustment plate openings, whereby said torque tube, said torsion bar and said arm means are pivotally adjusted into a desired exercising configuration responsive to manipulation of said adjustment handle and insertion of said adjustment plate pin in said pin opening and through a selected one of said adjustment plate openings.

5. The torsion exercising device of claim 4 wherein said support means further comprises a support frame having a seat and a back support for receiving the exerciser in a seated position.

6. A torsion exercising device comprising a support frame having a seat and a back support for receiving the exerciser in a seated position; at least one pivot arm plate carried by said back support; a plurality of pivot arm plate openings provided in spaced relationship in said pivot arm plate; a pivot arm having one end pivotally carried by said pivot arm plate; a pivot arm pin adapted for projecting through a selected one of said pivot arm plate openings and engaging said pivot arm for orienting the opposite end of said pivot arm in a selected position with respect to said support frame; a mount bar fixedly carried by said opposite end of said pivot arm; bracket means provided on each end of said mount bar and a torque tube pivotally carried by said bracket means in spaced relationship with respect to said mount bar; arm means fixedly carried by said torque tube; a torsion bar slidably disposed in said torque tube for adjusting the torque in said torsion bar; and adjustable lock means carried by one end of said torsion bar for locking said torsion bar in a selected orientation with respect to said mount bar, whereby a torsional force is created in said torsion bar responsive to movement of said arm means by the exerciser.

7. The torsion exercising device of claim 6 wherein said arm means further comprises a pair of arms extending from said torque tube in spaced relationship.

8. The torsion exercising device of claim 6 wherein said adjustable lock means further comprises an adjustment handle having one end attached to said torsion bar; a pin opening provided in said adjustment handle; an adjustment plate fixedly carried by said mount bar;

adjustment plate openings provided in said adjustment plate in spaced relationship; and an adjustment plate pin for selective registration with said pin opening and said adjustment plate openings, whereby said torque tube, said torsion bar and said arm means are pivotally adjusted into a desired exercising configuration responsive to manipulation of said adjustment handle and insertion of said adjustment plate pin in said pin opening and through a selected one of said adjustment plate openings.

9. The torsion exercising device of claim 6 wherein:

(a) said arm means further comprises a pair of arms extending from said torque tube in spaced relationship; and (b) said adjustable lock means further comprises an adjustment handle having one end attached to said torsion bar; a pin opening provided in said adjustment handle; an adjustment plate fixedly carried by said mount bar; adjustment plate openings provided in said adjustment plate in spaced relationship; and an adjustment plate pin for selective registration with said pin opening and said adjustment plate openings, whereby said torque tube, said torsion bar and said arms are pivotally adjusted into a desired exercising configuration responsive to manipulation of said adjustment handle and insertion of said adjustment plate pin in said pin opening and through a selected one of said adjustment plate openings.

10. A torsion exercising device comprising a support frame having a seat and a back support for receiving the exerciser in a seated position; a pair of pivot arm plates carried by said back support in fixed substantially parallel relationship; a plurality of pivot arm plate openings provided in spaced, aligned relationship in said pivot arm plates, respectively; a pivot arm having one end pivotally disposed between said pivot arm plates; a pivot arm pin adapted for projecting through selected aligned ones of said pivot arm plate openings and engaging said one end of said pivot arm for orienting the opposite end of said pivot arm in a selected position with respect to said support frame; a mount bar fixedly carried by said opposite end of said pivot arm; bracket means provided on each end of said mount bar and a torque tube pivotally carried by said bracket means in spaced relationship with respect to said mount bar; arm means fixedly carried by said torque tube; a torsion bar slidably disposed in said torque tube for adjusting the torque in said torsion bar; and adjustable lock means carried by one end of said torsion bar for locking said torsion bar in a selected orientation with respect to said mount bar, whereby a torsional force is created in said torsion bar responsive to movement of said arm means by the exerciser.

11. The torsion exercising device of claim 10 wherein said arm means further comprises a pair of arms extending from said torque tube in spaced relationship.

12. The torsion exercising device of claim 10 wherein said adjustable lock means further comprises an adjustment handle having one end attached to said torsion bar; a pin opening provided in said adjustment handle; an adjustment plate fixedly carried by said mount bar; adjustment plate openings provided in said adjustment plate in spaced relationship; and an adjustment plate pin for selective registration with said pin opening and said adjustment plate openings, whereby said torque tube, said torsion bar and said arm means are pivotally adjusted into a desired exercising configuration responsive to manipulation of said adjustment handle and insertion of said adjustment plate pin in said pin opening and through a selected one of said adjustment plate openings.

13. The torsion exercising device of claim 10 wherein:

(a) said arm means further comprises a pair of arms extending from said torque tube in spaced relationship; and (b) said adjustable lock means further comprises an adjustment handle having one end attached to said torsion bar; a pin opening provided in said adjustment handle; an adjustment plate fixedly carried by said mount bar; adjustment plate openings provided in said adjustment plate in spaced relationship; and an adjustment plate pin for selective registration with said pin opening and said adjustment plate openings, whereby said torque tube, said torsion bar and said arms are pivotally adjusted into a desired exercising configuration responsive to manipulation of said adjustment handle and insertion of said adjustment plate pin in said pin opening and through a selected one of said adjustment plate openings.

* * * * *